US006079447A

United States Patent [19]

Holzheimer et al.

[11] Patent Number: 6,079,447

[45] Date of Patent: Jun. 27, 2000

[54] FAUCET MOUNTING SYSTEM WITH IMPROVED STAND

[75] Inventors: John C. Holzheimer, Eastlake; Nagib Nasr, Westlake; Mark W. Roth, Elyria, all of Ohio

[73] Assignee: Moen Incorporated, North Olmsted, Ohio

[21] Appl. No.: 09/263,576

[22] Filed: Mar. 8, 1999

[51] Int. Cl.[7] ..... E03C 1/04

[52] U.S. Cl. ..... 137/801; 4/677

[58] Field of Search ..... 137/801; 4/677

[56] References Cited

U.S. PATENT DOCUMENTS

| | | |
|---|---|---|
| 2,878,489 | 3/1959 | Graham . |
| 4,456,287 | 6/1984 | Bisonaya . |
| 4,592,388 | 6/1986 | Wilcox . |
| 4,827,538 | 5/1989 | Heimann et al. . |
| 4,856,121 | 8/1989 | Traylor . |
| 4,856,122 | 8/1989 | Pilolla . |
| 4,997,008 | 3/1991 | Zbin . |
| 5,349,987 | 9/1994 | Shieh . |
| 5,381,830 | 1/1995 | Niemann et al. . |
| 5,388,287 | 2/1995 | Tischler et al. . |
| 5,535,776 | 7/1996 | Kingman . |
| 5,575,424 | 11/1996 | Fleischmann . |

*Primary Examiner*—Gerald A. Michalsky
*Attorney, Agent, or Firm*—McEachran, Jambor, Keating, Bock & Kurtz

[57] ABSTRACT

A faucet mounting system for positioning and supporting a faucet valve body and a rotatable faucet receptor on a sink deck includes a stand. The valve body is mounted in the stand above the sink deck and there is a bearing member which supports the stand on the sink deck. The receptor is rotatable about the stand and has a faucet wand support portion and there is a hose extending through the receptor and faucet wand support portion. The stand has a vertical wall which is at least in part discontinuous for passage of the hose. An upper portion of the stand vertical wall interlocks the stand and the valve body and there is a shelf on the inside of the vertical wall which supports the valve body above the sink deck.

13 Claims, 3 Drawing Sheets

32
30
10
102
90
28
84
88
104
26
72
60
16
36
38
20
24
22
18
98
64
70
68
66
54
58
42
52
50
14
12
62
80
76
74
5

Fig. 5.
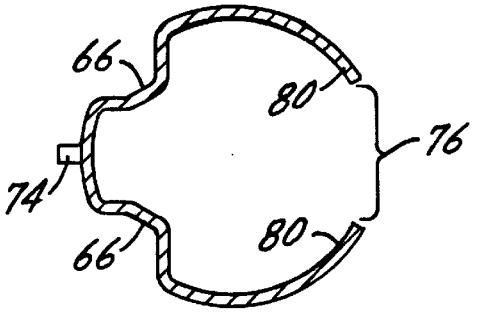
Fig. 6.
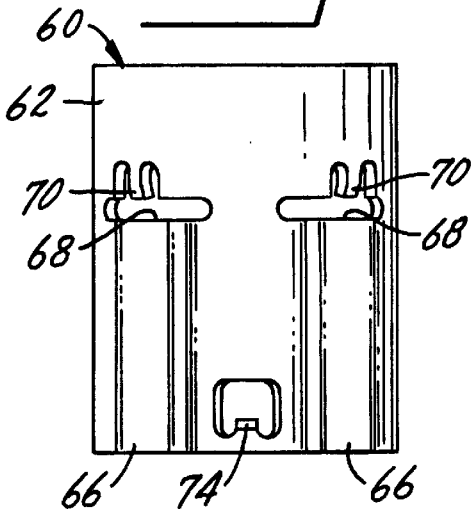
Fig. 7.
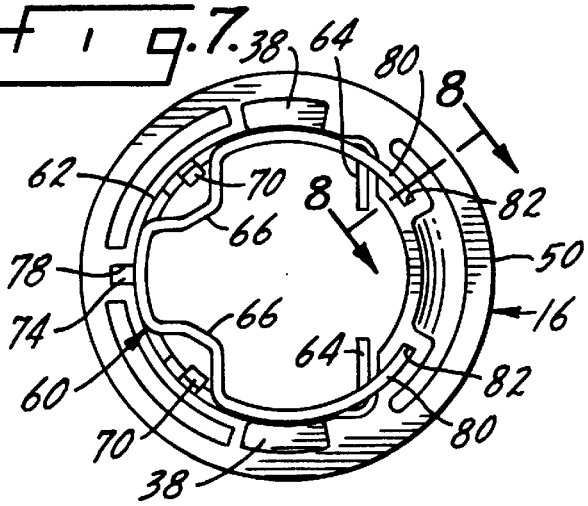
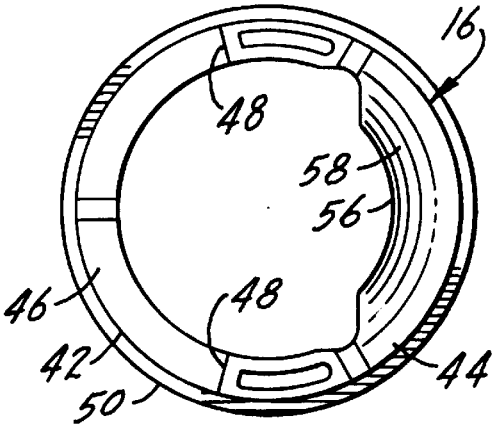
Fig. 9.
Fig. 11.
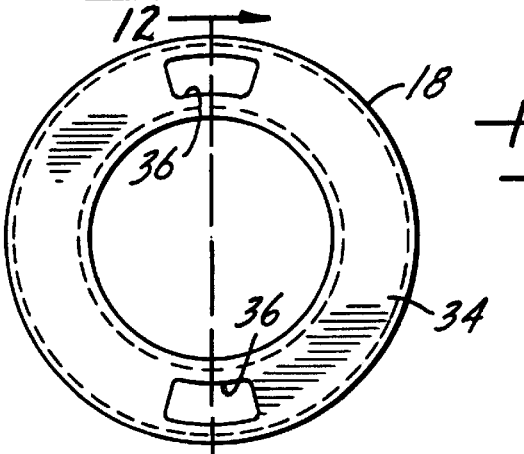
Fig. 8.
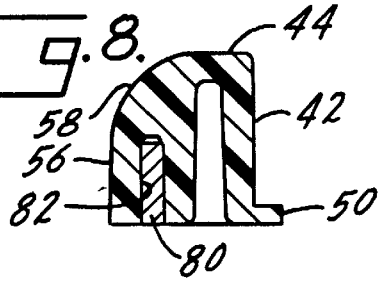
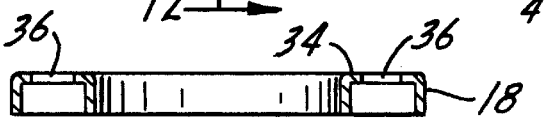
Fig. 12.
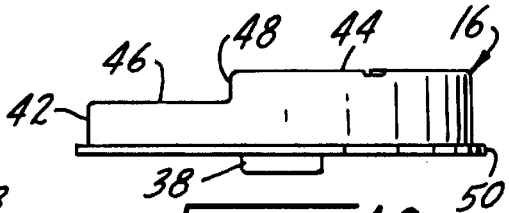
Fig. 10.

Fig. 13.
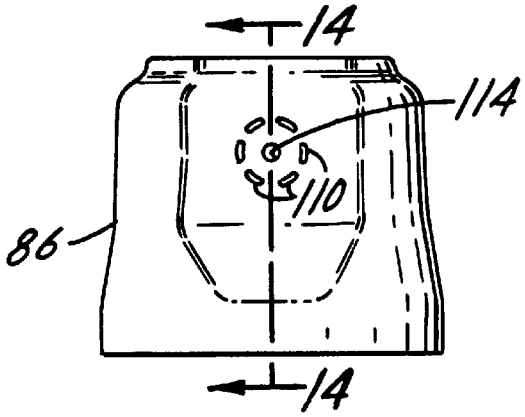
Fig. 14.
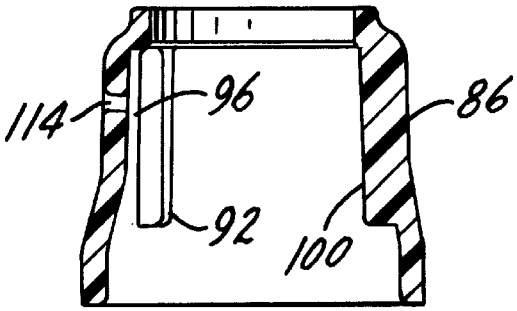
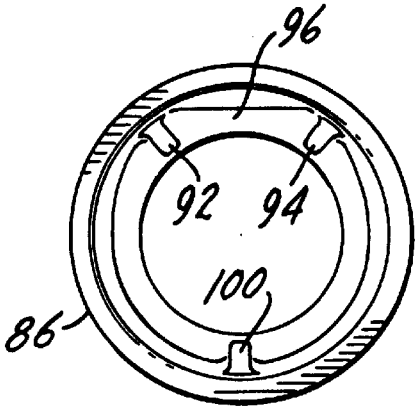
Fig. 15.
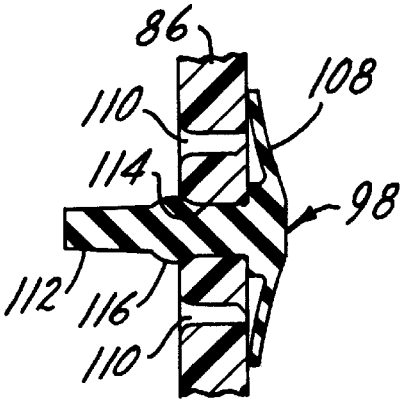
Fig. 16.
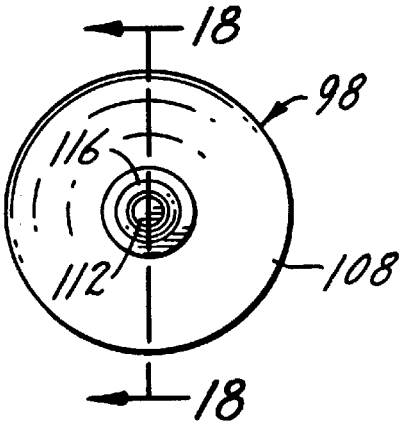
Fig. 17.
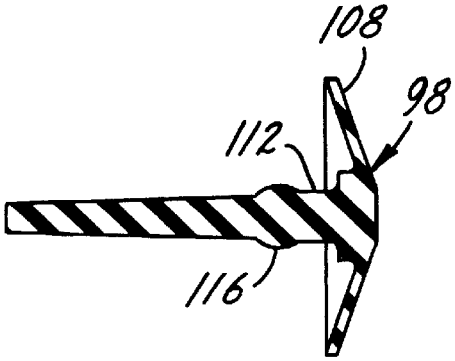
Fig. 18.

FAUCET MOUNTING SYSTEM WITH IMPROVED STAND

THE FIELD OF THE INVENTION

The present invention relates to a faucet mounting system and more particularly to a stand for mounting the valve body of a pullout faucet. Pullout faucets have an exterior rotatable receptor which supports the pullout wand and which encloses the valve body. Frequently, the valve body extends a substantial distance above the sink deck to provide space for the hose, which attaches to the wand, to move easily when the wand is removed from the receptor. Valve bodies are typically made of brass and if the valve body is to have its control stem located a substantial distance above the deck escutcheon, this could lead to an elongated brass valve body, and one which would be prohibitively expensive. The present invention solves both the problem of providing space for movement of the hose and a to more inexpensive construction by using a hollow stand to support the valve body above the sink deck.

The stand has several requirements. It must withstand the installation load of the faucet valve body without deforming, that is changing the specific orientation of the valve body to the sink deck. The stand must have sufficient clearance to allow the hose to move freely when the receptor rotates. Further, the material for the stand must be similar to the brass material used in the valve body in order to reduce the potential for corrosion due to electrolytic activity. Stainless steel has been found to be a satisfactory material to meet all of tile requirements for a stand in this environment.

The present invention provides a stand, preferably made of stainless steel, which is in the form of a partially discontinuous cylinder having vertical support ribs, a shelf to support the valve body and tabs and projections to interlock with the valve body and hold it above the sink deck and at the required orientation relative to the sink.

SUMMARY OF THE INVENTION

The present invention relates to faucet mounting systems and more specifically to the stand for supporting a valve body within a pullout wand faucet.

A primary purpose of the invention is a stand for the use described which has adequate strength to support the valve body during installation of the faucet and is made of a material which reduces the electrolytic activity between the stand and the valve body, thus resisting corrosion.

Another purpose is a faucet mounting system for the use described which includes a stand made of stainless steel, which has vertical ribs to increase vertical strength, with the upper surface of the ribs providing a shelf to support the valve body.

Another purpose is a stand of the type described which has tabs and projections to interlock with the valve body and the support system on the sink deck to securely hold the valve body, and maintain its proper orientation relative to the sink.

Another purpose is a stand for the use described which has a wider opening than prior art stands thus providing greater receptor rotation during use of the faucet.

DESCRIPTION OF THE DRAWINGS

The invention is illustrated diagrammatically in the following drawings wherein:

FIG. 5 is a section along plane 5—5 of FIG. 3;

FIG. 6 is a rear view of the stand;

FIG. 7 is a bottom view of the stand and bearing support member;

FIG. 8 is a section along plane 8—8 of FIG. 7;

FIG. 9 is a top view of the bearing support member;

FIG. 10 is a side view of the bearing support member;

FIG. 11 is a top view of the escutcheon positioned between the receptor and stand;

FIG. 12 is a section along plane 12—12 of FIG. 11;

FIG. 13 is a side view of the faucet body hub;

FIG. 14 is a section along plane 14—14 of FIG. 13;

FIG. 15 is a bottom view of the hub;

FIG. 16 is a side view of the hub mounted vacuum breaker;

FIG. 17 is an end view of the vacuum breaker; and

FIG. 18 is a section along plane 18—18 of FIG. 17;

DESCRIPTION OF THE PREFERRED EMBODIMENT

Figures 1, 2, 3, 4:
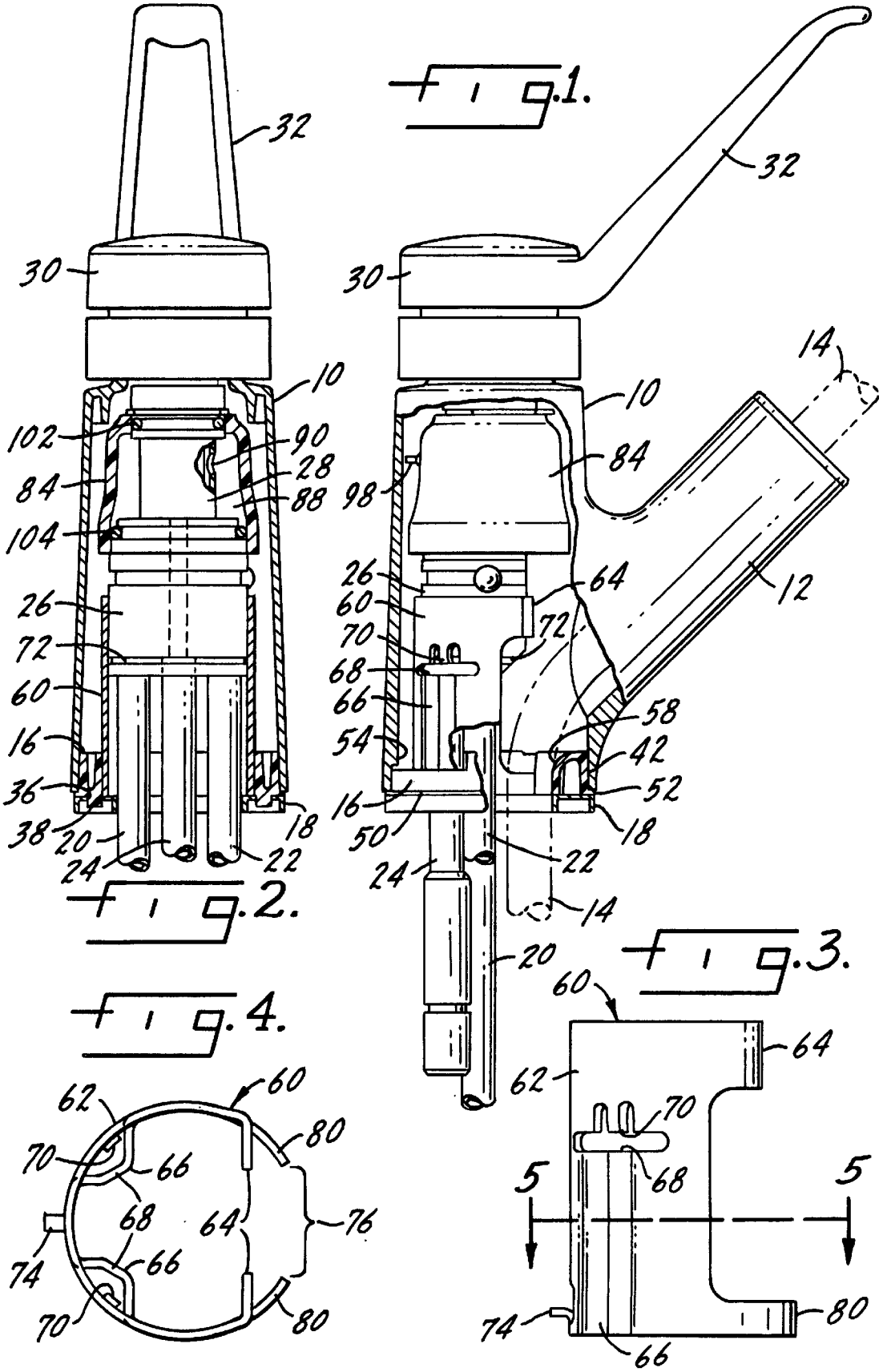
FIG. 1 is a side view of a faucet assembly of the type described, in part section.
FIG. 2 is a rear view of the faucet assembly of FIG. 1, in part section.
FIG. 3 is a side view of the support stand.
FIG. 4 is a top view of the stand.

FIG. 1 illustrates a pullout wand faucet, customarily found in the kitchen and which includes a receptor indicated generally at 10 which has a spout support portion 12 20 which will receive the faucet wand, not shown. The hose for the faucet wand is indicated at 14 in broken lines and extends through the faucet assembly from the wand down to the area beneath the sink deck. The receptor 10, which may be formed of plastic or of a metallic material, and which will be decorative in nature, encloses the valve body assembly and is mounted for rotation upon a bearing member 16, The bearing member 16 in turn is seated upon an escutcheon 18 which is in the form of a ring, and is illustrated in FIGS. 11and 12. Other forms of escutcheons clearly are acceptable to support the valve assembly shown herein.

There are hot and cold water inlet conduits 20 and 22 and there is an outlet conduit 24 which will be connected to the hose 14. The conduits 20, 22 and 24 all extend into a valve body 26 which may contain a single lever valve control cartridge of the type sold by applicant, Moen Incorporated, under the trademark 1225. This cartridge is located within a cylindrical portion 28 of the valve body 26 and will have an upwardly extending stem to which will be connected the cap assembly indicated at 30 and the lever 32. Manipulation of the lever 32 will control the volume and temperature of water supplied through the hose and thus discharged from the faucet wand.

The escutcheon or ring 18 has a top surface 34 with a pair of limited arcuate slots 36 which slots will receive the downwardly extending arcuate projections 38 on the bottom of the bearing member 16, illustrated in detail in FIGS. 9 and 10 and shown combined with the stand in FIG. 7. The bearing member 16 which is preferably formed of plastic to provide electrolytic isolation between the metallic ring or escutcheon 18 and the metallic valve body 26 provides support for rotation of the receptor 10. Member 16 has an upstanding vertical wall 42 which has a first portion 44 of a greater vertical height than a second portion 46 with the junction between the portions 44 and 46 forming vertical stops 48 which limit rotation of the receptor 10. The member 16 has an outwardly extending circumferential or peripheral flange 50 which provides support for the bottom surface 52 of the receptor 10. Thus, the receptor 10 may rotate upon the bearing member and its interior surface 54 will contact the stops 48 to limit its rotation. In prior faucet assemblies of this type, rotation of the receptor was customarily limited to approximately 85 degrees. However, with the support assembly described herein, spout rotation has been expanded to approximately 145 degrees. This is clearly shown in FIG. 9.

The bearing member 16 has an arcuate portion 56, illustrated in FIG. 9 and in section in FIG. 8, which has a gradually curved surface 58 which curved surface will face the spout portion 12 of the receptor when the valve assembly is mounted on a sink deck. The hose 14 thus has a smooth non-metallic surface over which it will move when the wand is pulled out of the receptor. This is in contrast to prior art structures in which there was no such smooth non-metallic surface for movement of the hose which normally has a metallic outer sheath and thus there was both noise from hose movement and wear on the exterior of the hose. The present invention eliminates both the noise and the wear problem by the use of a non-metallic bearing member which has a curved surface over which the hose may move.

The valve body 26, which preferably is made of brass, is supported within the faucet assembly by a stand 60 illustrated in FIGS. 3, 4, 5 and 6, and in assembled version with the bearing member, in FIG. 7. Preferably the stand is formed of stainless steel. The stand must be inexpensive, but it must withstand the installation load of the faucet body without deforming and thus altering the specific orientation of the valve body. Tile stand must have sufficient clearance to allow the hose to move freely when the spout rotates and the material forming the stand should be similar to brass in terms of electromotive force to reduce the potential for corrosion due to electrolytic activity. The preferred material for the stand is thus stainless steel.

The stand has a generally vertical wall 62, the upper end of which has two inwardly extending tabs or projections 64 which will secure the valve body in position by bearing against a portion thereof as shown in FIG. 1. Thus, the upper end of the stand securely holds the valve body in position. The stand has two vertical ribs indicated at 66 which not only increase the vertical strength of the stand but provide a shelf at their upper end surfaces 68 for support of the valve body. The valve body 26 is held by the tabs 64 and to is seated upon the vertical ribs 66. Further, the vertical wall 62 of the stand has a pair of in turned projections 70 which will extend into an annular groove 72 on the exterior of the valve body. The valve body, when assembled, will be pushed down into the stand until the projections 70 snap into the groove 72, thus permanently holding the valve body within the stand. The interengagement between the valve body and the stand includes the ribs 66, the tabs 64 and the projections 70, all combining to firmly hold the valve body in position within the stand.

The lower portion of the stand will interlock with the bearing member 16. As shown particularly in FIG. 4, a rear portion of the stand has a generally horizontally extending projection 74 which is opposite a spout opening 76 in the stand, which opening is there to accommodate movement of the hose. The projection 74 will be received within a recess 78 in the bearing member 16, as particularly shown in FIG. 7. This properly aligns the stand with the bearing member and the bearing member, as discussed above, is properly aligned with the escutcheon on the sink deck by the slots 36 and projections 38. To further hold the stand within the bearing member, the lower portion of the stand has a pair of arcuately extending projections 80, shown in FIG. 5 which will extend within arcuate grooves 82 in the lower, downwardly facing portion, of the bearing member 16. This interlocking arrangement is shown particularly in FIG. 7. The arcuate projections or extensions 80 and the mating grooves 82 on the stand and bearing member combined with the aligning projection 74 and the recess 78 all together serve to not only positively and firmly connect the stand with the bearing member, but also to align these two elements so that the entire faucet assembly will be properly located on the sink deck.

As is common and required in faucets of this kind, there must be a vacuum breaker. In the present instance, at the upper portion of the valve body, there is a vacuum vent assembly 84 which includes a hub 86 extending over the upper portion of the valve body adjacent to the location of the valve cartridge. The area inside of the hub 86 will form a chamber 88 which will receive water discharged from the valve cartridge through outlet port 90. The hub 86 as shown in FIGS. 14 and 15 may have three downwardly extending ribs, two of which, indicated at 92 and 94, are positioned closely adjacent to the vacuum breaker 98 to define a vacuum breaker chamber 96. The ribs 92 and 94 isolate water discharged from the cartridge, which may contain contamination such as sediment, from the vacuum breaker. In prior art vacuum breakers, the seal element was exposed to direct water flow which allowed contamination to get under the seal surface. This is prevented in the present construction by the use of the ribs 92 and 94. There is a third rib 100 which assists in locating the hub on the exterior surface of the valve body 26. The hub is preferably formed of plastic and will be sealed at its upper and lower extremities by seal rings 102 and 104 which are formed on the cylindrical portion 28 of the valve body which encloses the cartridge.

The vacuum breaker itself, indicated at 98 is elastomeric in form and has an umbrella portion 108 which masks a group of openings 110 in the wall of the hub 86. There is a stem 112 which extends through a hole 114 in the hub with the stem having an enlargement 116 which serves to fix the vacuum breaker to the hub.

In normal use, the umbrella portion 108 will close over the openings 110 so that no water is discharged from the hub. The outside of the hub will be at atmospheric pressure. In the event that there is a drop in line pressure supplying the faucet, and if at that time the wand were to be located in water within a sink, the negative pressure from the water supply could draw unclean water from the sink back through the faucet assembly into the water supply. However, this is prevented by the vacuum breaker assembly as if such a negative pressure were to occur, the atmospheric air outside of the hub would force its way inward, pushing the umbrella portion 108 away from the holes 10 and breaking the vacuum, preventing the backward flow of water from the sink through the faucet assembly into the potable water supply.

Of particular advantage in the invention is the unique support system for the valve body which includes the stand and the bearing member. These two elements combined not only support the faucet valve body, but they do so in a manner to provide a greater degree of rotation of the receptor relative to the sink deck, plus they eliminate wear and noise caused by movement of the hose through the faucet assembly. The use of a non-metallic bearing member eliminates the often troublesome clicking noise when the receptor is moved to the limits of its rotation. The stand is strong, being formed of stainless steel, has supporting vertical ribs, and is made of a material which will reduce electrolytic action between the valve body and the other elements of the assembly, thus lowering the potential for corrosion.

Whereas the preferred form of the invention has been shown and described herein, it should be realized that there may be many modifications, substitutions and alterations thereto.

We claim:

1. A faucet mounting system for positioning and supporting a faucet valve body and a rotatable faucet receptor on a sink deck, said mounting system including a stand, said valve body being mounted in said stand above the sink deck, means for mounting said stand on the sink deck, said receptor being rotatable above said stand and having a faucet wand support portion, a hose extending through said receptor and faucet wand support portion, said stand having a vertical wall, which is, at least in part, discontinuous for passage of said hose, means at an upper portion of said vertical wall for interlocking said stand and valve body, and shelf means on the inside of said vertical wall supporting said valve body above the sink deck.

2. The faucet mounting system of claim 1 wherein said shelf includes a plurality of vertically extending ribs, the upper end thereof forming said shelf.

3. The faucet mounting system of claim 1 wherein said valve body and said stand are made of dissimilar metals such that the electromotive force therebetween is at a minimum to reduce the potential for corrosion due to electrolytic activity.

4. The faucet mounting system of claim 3 wherein said valve body is made of brass and said stand is made of stainless steel.

5. The faucet mounting system of claim 1 wherein said stand vertical wall is circumferentially discontinuous.

6. The faucet mounting system of claim 1 wherein an upper portion of said vertical wall has inwardly extending tabs, said tabs interlocking with a flat surface on said valve body to hold said valve body within said stand.

7. The faucet mounting system of claim 6 wherein said vertical wall has inwardly extending projections intermediate upper and lower ends thereof, said valve body has a peripherally extending arcuate recess, with said projections extending into said recess to interlock said valve body to said stand.

8. The faucet mounting system of claim 1 wherein said vertical wall has vertically extending inwardly directed projections to provide stiffening support for said wall.

9. The faucet mounting system of claim 8 wherein said inwardly directed projections terminate beneath an upper end of said vertical wall, with upper ends of said inwardly directed projections forming shelves to support said valve body in said stand.

10. The faucet mounting system of claim 1 wherein the means for mounting said stand on the sink deck include a bearing member formed and adapted to be mounted on the sink deck and having a central opening to accommodate water conduits and said hose.

11. The faucet mounting system of claim 10 wherein said bearing member includes at least one circumferentially extending recess and said stand includes at least one circumferentially extending projection positioned within said recess to mount and locate said stand on said bearing member.

12. The faucet mounting system of claim 11 wherein said bearing member includes a pair of oppositely facing circumferentially extending recesses, and said stand includes a pair of facing circumferentially extending projections extending into said recesses for providing an interlock between said stand and bearing member.

13. The faucet mounting system of claim 11 wherein said bearing member includes a radial recess on the interior thereof and said stand includes a radially outwardly extending projection positioned within said recess for positioning and aligning said stand and said bearing member.

* * * * *